US005853038A

United States Patent [19]

Newnes

[11] Patent Number: 5,853,038

[45] Date of Patent: Dec. 29, 1998

[54] METHOD AND APPARATUS FOR THE VARIABLE POSITION FEEDING OF A GANG SAW

[75] Inventor: William R. Newnes, Salmon Arm, Canada

[73] Assignee: Newnes Machine Ltd., Salmon Arm, Canada

[21] Appl. No.: 827,264

[22] Filed: Mar. 28, 1997

Related U.S. Application Data

[60] Provisional application No. 60/014,319 Mar. 29, 1996.

[51] Int. Cl. [6] ..... B27B 1/00; B27B 31/00

[52] U.S. Cl. ..... 144/357; 83/367; 144/245.2; 144/250.23; 144/378; 198/624

[58] Field of Search ..... 83/365, 367, 422, 83/436.15; 144/39, 3.1, 242.1, 245.2, 245.3, 250.13, 250.16, 250.17, 376, 377, 378, 356, 357

[56] References Cited

U.S. PATENT DOCUMENTS

| | | | |
|---|---|---|---|
| 4,106,538 | 8/1978 | Sigfridsson et al. | 144/245.2 |
| 4,373,563 | 2/1983 | Kenyon | 144/357 |
| 4,383,561 | 5/1983 | Gregroire et al. | 144/245 |
| 4,572,256 | 2/1986 | Rautio | 144/39 |
| 4,599,929 | 7/1986 | Dutina | 83/821 |
| 4,690,188 | 9/1987 | Hasenwinkle | 144/378 |
| 4,881,584 | 11/1989 | Wislocker et al. | 144/39 |
| 4,997,017 | 3/1991 | Dobbie | 144/245.2 |
| 5,115,846 | 5/1992 | Miller et al. | 144/246.1 |
| 5,148,847 | 9/1992 | Knerr | 144/357 |
| 5,320,153 | 6/1994 | Knerr | 144/357 |
| 5,368,080 | 11/1994 | Homel | 144/250.23 |
| 5,400,842 | 3/1995 | Brisson | 144/2 |
| 5,429,161 | 7/1995 | Allard | 144/246 |
| 5,469,904 | 11/1995 | Contianen | 144/370 |

FOREIGN PATENT DOCUMENTS 2022857 4/1996 Canada .

*Primary Examiner*—W. Donald Bray
*Attorney, Agent, or Firm*—Larson & Taylor

[57] ABSTRACT

A device for feeding a workpiece into a gang saw sawblade cluster has a longitudinal drive for selectively longitudinally translating a workpiece, which has been sequenced onto the longitudinal drive, into a gang saw sawblade cluster, and a selective positioner for selectively positioning and presetting for each workpiece the longitudinal drive height relative to the gang saw sawblade cluster as the longitudinal drive translates the workpiece longitudinally into the gang saw sawblade cluster.

20 Claims, 6 Drawing Sheets

METHOD AND APPARATUS FOR THE VARIABLE POSITION FEEDING OF A GANG SAW

FIELD OF THE INVENTION

This is a Provisional Application Ser. No. 60/014,319 filed Mar. 29, 1996.

This invention relates to a method and a device for sawing lumber from cants, and in particular relates to a cant feeding system.

BACKGROUND OF THE INVENTION

A canted log, or "cant", by definition has first and second opposed cut planar faces. In the prior art, cants were fed straight through a profiler or gang saw so as to produce a third planar face, or multiple boards, either approximately parallel to the center line of the cant, so called split taper sawing, or approximately parallel to one side of the cant, so called full taper sawing; or at a slope somewhere between split and full taper sawing. For straight cants, using these methods for volume recovery of the lumber can be close to optimal. However, logs often have a curvature and usually a curved log will be cut to a shorter length to minimize the loss of recovery due to this curvature. Consequently, in the prior art, various curve sawing techniques have been used to overcome this problem so that longer length lumber with higher recovery may be achieved.

Curve sawing typically uses a mechanical centering system that guides a cant into a secondary break-down machine with chipping heads or saws. This centering action results in the cant following a path very closely parallel to the center line of the cant, thus resulting in split taper chipping or sawing of the cant. Cants that are curve sawn by this technique generally produce longer, wider and stronger boards than is typically possible with a straight sawing technique where the cant has significant curvature.

Curve sawing techniques have also been applied to cut parallel to a curved face of a cant, i.e. full taper sawing. See for example Kenyan, U.S. Pat. No. 4,373,563 and Lundstrom, Canadian Patent No. 2,022,857. Both the Kenyan and Lundstrom devices use mechanical means to center the cant during curve sawing and thus disparities on the surface of the cant such as scars, knots, branch stubs and the like tend to disturb the machining operation and produce a "wave" in the cant. It has also been found that full taper curve sawing techniques, because the cut follows a line approximately parallel to the convex or concave surface of the cant, can only produce lumber that mimics these surfaces, and the shape produced may be unacceptably bowed.

Thus in the prior art, so called arc-sawing was developed. See for example U.S. Pat. No. 5,148,847 and 5,320,153. Arc sawing was developed to saw irregular swept cants in a radial arc. The technique employs an electronic evaluation and control unit to determine the best semi-circular arc solution to machine the cant, based, in part, on the cant profile information. Arc sawing techniques solve the mechanical centering problems encountered with curve sawing but limit the recovery possible from a cant by constraining the cut solution to a radial form.

Applicant is also aware of U.S. Pat. No. 4,373,563, U.S. Pat .No. 4,690,188, U.S. Pat. No. 4,572,256, U.S. Pat. No. 4,599,929, U.S. Pat. No. 4,881,584, U.S. Pat. No. 5,320,153, U.S. Pat. No. 5,400,842, U.S. Pat. No. 4,599,929, and U.S. Pat. No. 5,469,904, are all designs that relate to the curve sawing of 2 sided cants.

It has been found that optimized lumber recovery is best obtained for most if not all cants if a unique cutting solution is determined for every cant. Thus for each cant a "best" curve is determined, which in some instances is merely a straight line parallel to the center line of the cant, and in other instances a complex curve that is only vaguely related to the physical surfaces of the cant.

Thus it is an object of the present invention to improve recovery of lumber from cants and in particular irregular or crooked cants by employing a "best" curve and a unique cutting solution for each cant. To achieve this objective a two sided cant is positioned and can be accurately guided or driven into a gang saw to produce the "best" curve which includes smoothing technology.

It is also an object of the invention to produce an apparatus that can center the height of the cant on double arbor gang saws, aiming the middle of the cant at the top of the bottom saw and the bottom of the top saw, thus helping prevent mismatching of top and bottom cuts due to mismatched flexing of the sawblades which can occur with other curve sawing techniques that position the cant on a fixed bed and feed the bottom of the cant along the bed. In particular it is an object to position the elevation of a cant being fed into a gang saw so that the saw depth in the cant between upper and lower gang saws is equal. In prior techniques, no matter what the thickness of the cant is, the distance from the bed to the centered position does not vary. Therefore, when a thinner cant is being curve sawn it may be almost completely within the cutting diameter of the lower saws and only a small distance into the cutting diameter of the upper saws, which can cause the lower sawblade to be flexed differently that the upper saws, thus creating a mismatching of the kerf and a potential loss of board quality.

It is a further object of the invention to produce an apparatus that can elevate a cant as it is being fed into the gang saws so as to place the cant at an optimum elevated position relative to the position of the saw guides to thereby minimize the degrading effects of cuts from an overhead single arbor gang saw due to knots or the like in the cant causing flexing of the gang saw blades.

It is another object of the invention to produce an apparatus that is laterally positionable to feed the cant at different zones of saws (that is, zones having different saw spacing), either to the left, center or to the right of the saw clusters relative to the direction of flow, depending on the saw cluster width and the gang saw's capabilities. It is a further object, in one embodiment, to provide a gang saw which may be actively skewed and/or to actively laterally position the cant infeed apparatus so that the gang saws may cut according to an optimized curve sawing path.

It is a further object of the invention to provide an apparatus that may be retrofitted into existing single and double arbor gang saws.

SUMMARY OF THE INVENTION

The method and apparatus of the present invention is a method and apparatus for selectively positioning a cant for infeed into a gang saw, in curve sawing embodiments for use in curve sawing to optimize recovery based on measured cant shape, lumber value, operator input and mill requisites.

In curve sawing embodiments, first, an indexing transfer which temporarily holds the cant in a stationary position against a row of retractable duckers, or other means, regulates indexed release of the cant onto a sequencing transfer. The sequencing transfer then feeds the cants singly through a scanner, where the scanner reads the profile of the cant and sends the data to a decision processor.

An optimizing algorithm in the decision processor generates three dimensional profiles or models from the cant's measurements, calculates a complex "best" curve related to the contours of the cant, and selects a breakdown solution including a cut description that represents the highest value combination of products which can be produced from the cant. Data is then transmitted to a programmable logic controller (PLC) that in turn sends motion control information related to the optimum breakdown solution to the various machines so as to regulate relative motion between the machines to control the movement of the cant relative to cutting devices to produce the designated gang saw products.

The sequencing transfer queues the cant for release onto a positioning apparatus. The positioning apparatus includes a chainbed, or alternatively, a group of driven rollers below as well as above the cant. The chainbed, or alternatively, the group of driven rollers, may be selectively elevated to center the cant relative to the top of the lower saw blade cluster and the bottom of the top saw blade cluster in a double arbor gang saw, that is, to make the depth of upper and lower saw blade cuts equal, or to locate the top of the cant optimally close to the sawguides in an overhead single arbor gang saw. In one embodiment, the positioning apparatus is capable of translating laterally from side to side to either pre-position or actively position the cant in front of the selected gang saw combination, or board width zone, that has been determined by the optimizer decision processor to provide the optimum breakdown solution. The gang saw may be fixed or actively skewed for coordinated curve sawing, coordinated with the active lateral positioning of the cant infeed apparatus.

In summary, the present invention is a device for feeding a workpiece into a gang saw sawblade cluster comprising longitudinal drive means for selectively longitudinally translating a workpiece, which has been indexed or sequenced onto the longitudinal drive means, into a gang saw sawblade cluster, and selective positioning means for selectively positioning the longitudinal drive means relative to the gang saw sawblade cluster as the longitudinal drive means translates the workpiece longitudinally into the gang saw sawblade cluster. In a curve sawing embodiment, the selective positioning of the longitudinal drive means relative to the gang saw sawblade cluster is actively selectively coordinated with the selective longitudinal translation of the workpiece by the longitudinal drive means according to an optimizing algorithm, which operates on data, from a scanner, unique to the workpiece for generating a unique cutting solution for the workpiece, and may be coordinated in one embodiment with active selective positioning, as by skewing, of the gang saw.

The selective positioning means may include lateral translation means for selectively laterally translating the longitudinal drive means either to preset the infeed position of the cant or to actively position the cant during infeed into the gang saw, that is, so as to preset a starting feed position of the workpiece corresponding to a selected zone of the gang saw sawblade cluster and/or so as to actively position the workpiece for curve sawing as the longitudinal drive means translates the workpiece longitudinally into the gang saw sawblade cluster. The selective positioning means includes elevation means for selectively raising and lowering the longitudinal drive means so as to preset a feed elevation of the workpiece.

In the curve sawing embodiments, the device may also include, in combination, skewing means for actively skewing the gang saw sawblade cluster wherein the selective coordination according to the optimizing algorithm includes selective coordination of skewing of the sawblade cluster.

Where the gang saw sawblade cluster is a double saw arbor having upper and lower saw arbors, the elevation means advantageously selectively raises or lowers the longitudinal drive means to equalize the upper and lower saw cut depths for each workpiece.

Where the gang saw sawblade cluster is an overhead single arbor, the elevation means advantageously selectively raises or lowers the longitudinal drive means so as to place the workpiece into optimal proximity to saw guides on the saw arbor.

The device may be used in a method for feeding a workpiece into a gang saw sawblade cluster, the method including the steps of: (a) sequencing a workpiece onto a longitudinal drive means, (b) selectively longitudinally translating the workpiece from the longitudinal drive means into a gang saw sawblade cluster, and (c) selectively positioning, by means of a selective positioning means, the longitudinal drive means relative to the gang saw sawblade cluster as the longitudinal drive means translates the workpiece longitudinally into the gang saw sawblade cluster. In a curve sawing embodiment, the method includes the further step of coordinating the selective longitudinal translation of the workpiece by the longitudinal drive means and active selective positioning of the longitudinal drive means relative to the gang saw sawblade cluster according to an optimizing algorithm, wherein the optimizing algorithm operates on data, from a scanner, unique to the workpiece for generating a unique cutting solution for the workpiece.

Selective positioning of the longitudinal drive means includes selectively raising and lowering the longitudinal drive means, by elevation means, so as to preset feed elevation of the workpiece, relative to the gang saw sawblade cluster, as the longitudinal drive means translates the workpiece longitudinally into the gang saw sawblade cluster, to thereby equalize upper and lower saw cut depths in a double saw arbor gang saw or to thereby optimally position the workpiece relative to saw guides on the sawblades in a single saw arbor gang saw.

Selective positioning of the longitudinal drive means may include selectively laterally translating, by means of lateral translation means, the longitudinal drive means, so as to preset a starting feed position of the workpiece corresponding to a selected zone of the gang saw sawblade cluster and, in the curve sawing method, so as to actively laterally position the workpiece, as the longitudinal drive means translates the workpiece longitudinally into the gang saw sawblade cluster.

The curve sawing method may further include the step of actively skewing the gang saw sawblade cluster, by means of skewing means, about a skewing axis, wherein the step of selective coordination according to the optimizing algorithm includes selective coordination of the skewing of the sawblade cluster about the skewing axis.

The invention provides other advantages which will be made clear in the description of the preferred embodiments.

BRIEF DESCRIPTION OF THE DRAWINGS

The invention will be better understood by reference to drawings, wherein.

DETAILED DESCRIPTION OF THE PREFERRED EMBODIMENT

Figure 1:
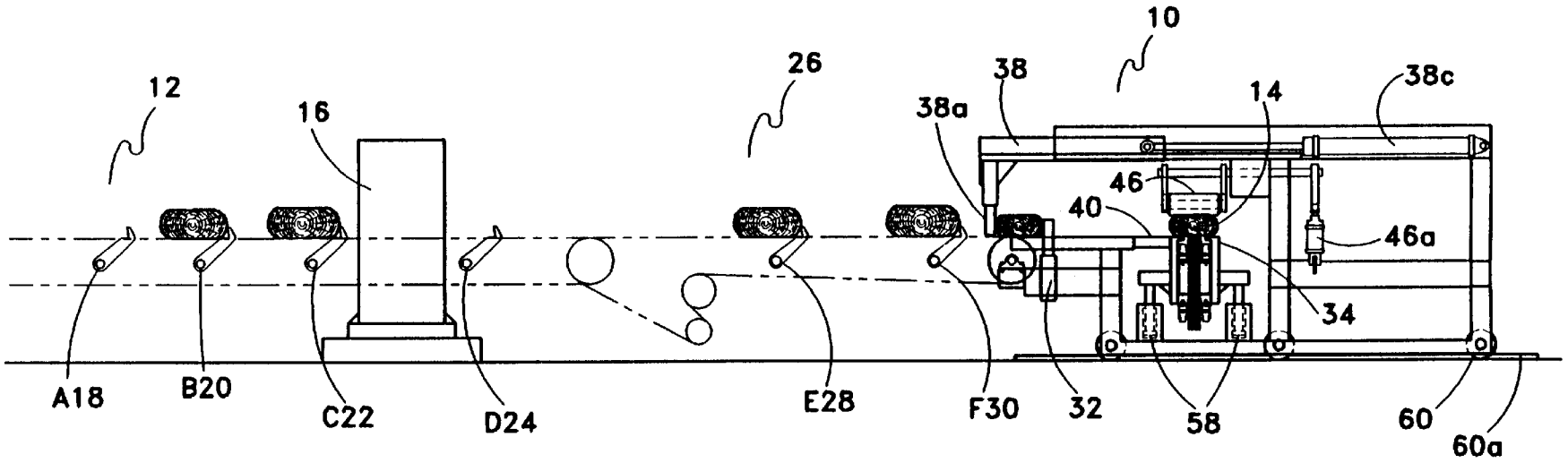
FIG. 1 is a side elevation section view according to a preferred embodiment of the invention, taken along section line 1—1 in FIG. 3.

Referring to the drawing figures wherein similar characters of reference represent corresponding parts in each view, the positioning table infeed apparatus is generally indicated by the reference numeral 10 and is seen in FIGS. 1–4.

A scanner indexing transfer 12 receives cant 14 from the mill and begins to index cant 14 towards scanner 16 in direction A. Ducker A18 receives cant 14. When ducker B20 on scanner indexing transfer 12 becomes available, cant 14 is sequenced from ducker A18 to ducker B20. Cant 14 is sequenced from ducker B20 to ducker C22 when ducker C22 becomes available. Ducker C22 is mounted just upstream of scanner 16.

When ducker D24 becomes available, cant 14 is released by ducker C22, whereby cant 14 then passes through the scanner 16, where scanner 16 scans cant 14. Cant 14 is passed to ducker D24. When ducker E28 on cant sequencing transfer 26 becomes available, cant 14 is sequenced from ducker D24 to ducker E28. When ducker F30 becomes available, cant 14 is sequenced from ducker E28 to ducker F30.

Figure 5:
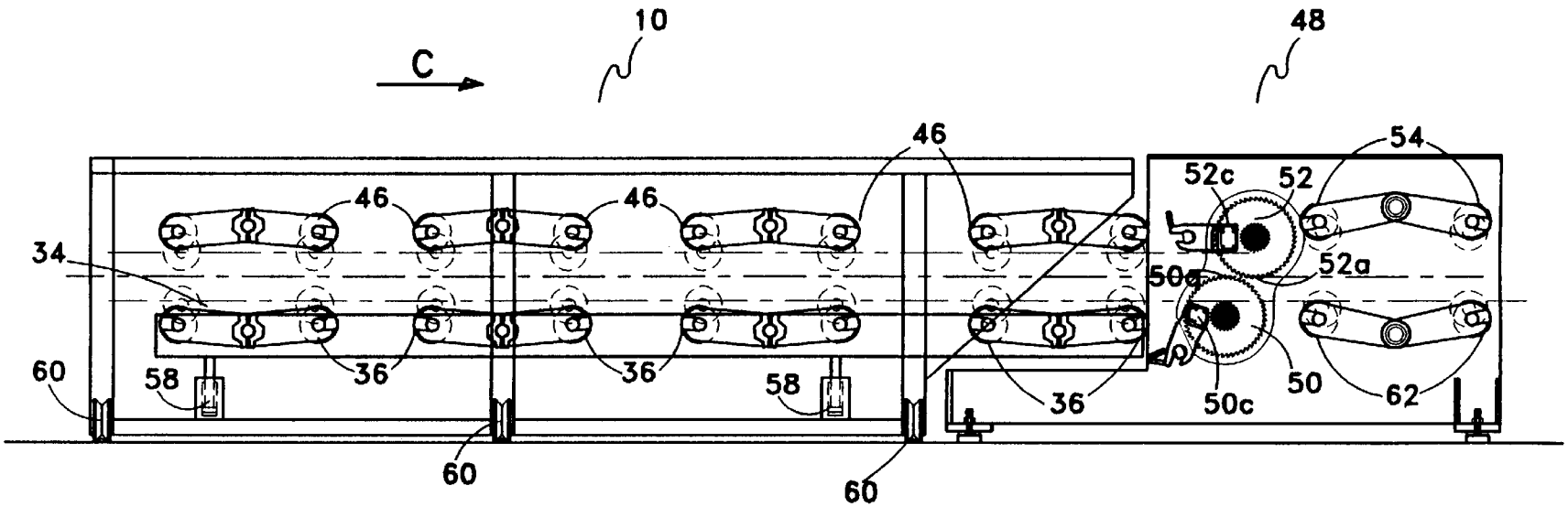
FIG. 5 is an elevation section view of an alternative embodiment of the invention.

Positioning table infeed apparatus 10 has park zone pins 32. When the park zone pins 32 become available, cant 14 is sequenced from ducker F30 to park zone pins 32. When chainbed 34 (or alternatively lower pressrolls 36, as seen in FIG. 5) become available, park zone pins 32 lower and a set of overhead positioning arms 38 lower overhead positioning pins 38*a* into engagement with cant 14. Overhead positioning arms 38 are retracted by positioning arm cylinders 38*c*, pulling cant 14 over skid bars 40 so as to center cant 14 on chainbed 34 (or, alternatively, lower infeed rollers 36 as seen in FIG. 5). Chainbed 34 is raised to contact the bottom of cant 14. Driven pressrolls 46, activated by pressroll cylinders 46*a* are pressed down to hold a constant pressure on cant 14 against chainbed 34. Chainbed 34 is then elevated by actuation of cylinders 58, or other selectively actuable elevating means. Where cant 14 is thick enough, it is to centered relative to both the top 50*a* of gang saw 48 lower saw blade cluster 50 and to the bottom 52*a* of the upper saw blade cluster 52 so as equal the depth of the upper and lower sawblade cuts. Otherwise, cant 14 is selectively elevated to be cut by a single sawblade arbor.

Figure 2:
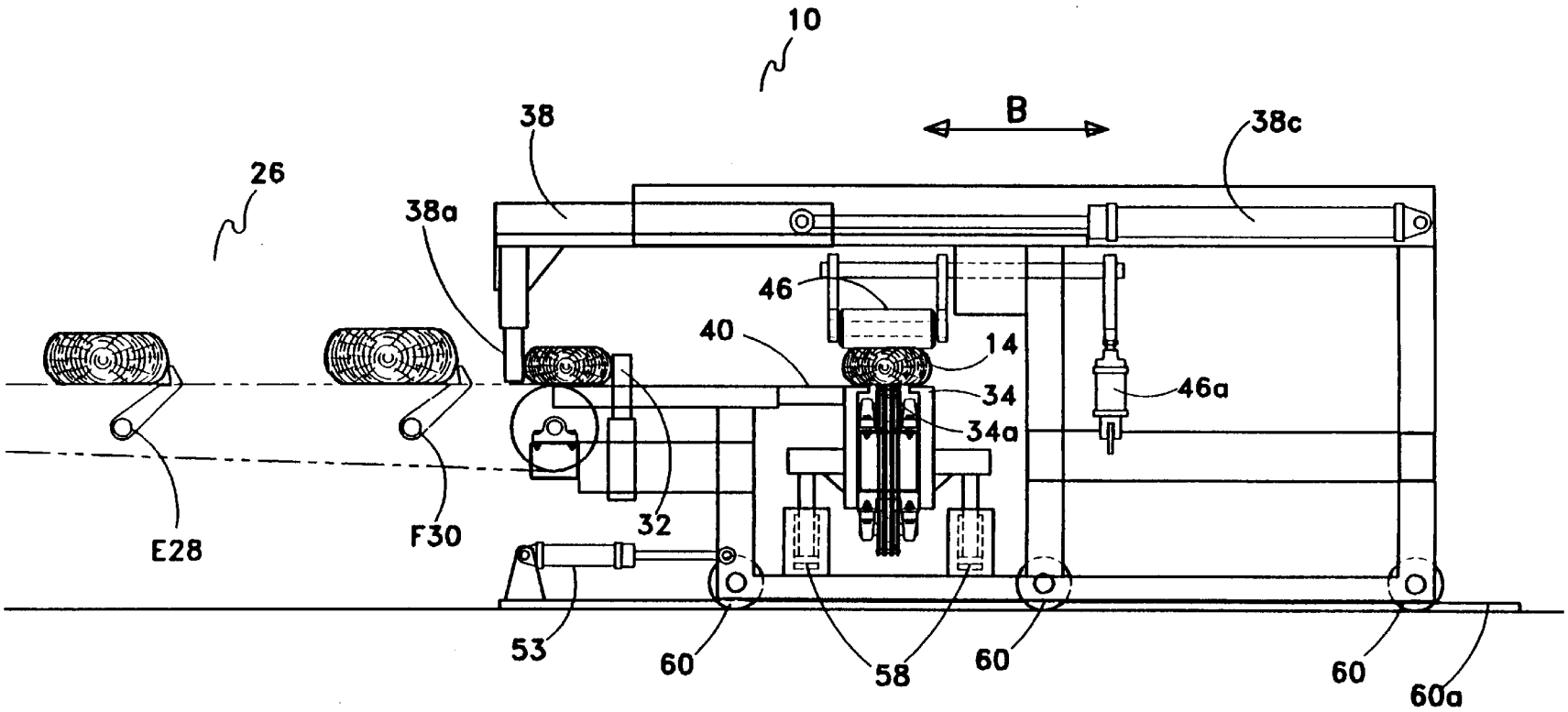
FIG. 2 is an enlarged view of the side elevation section view of FIG. 1.
Figure 3:
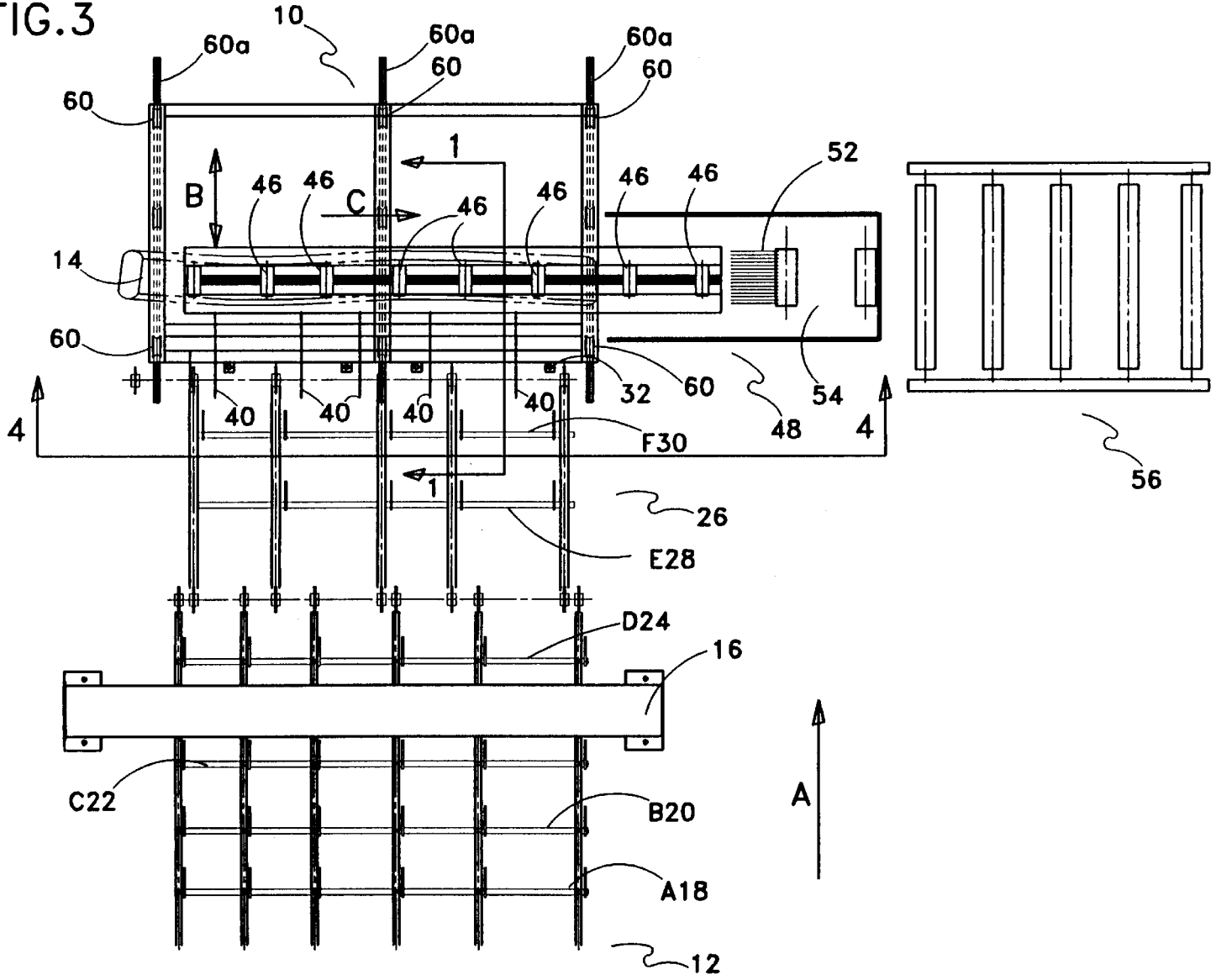
FIG. 3 is a plan view of the embodiment of FIG. 1.
Figure 4:
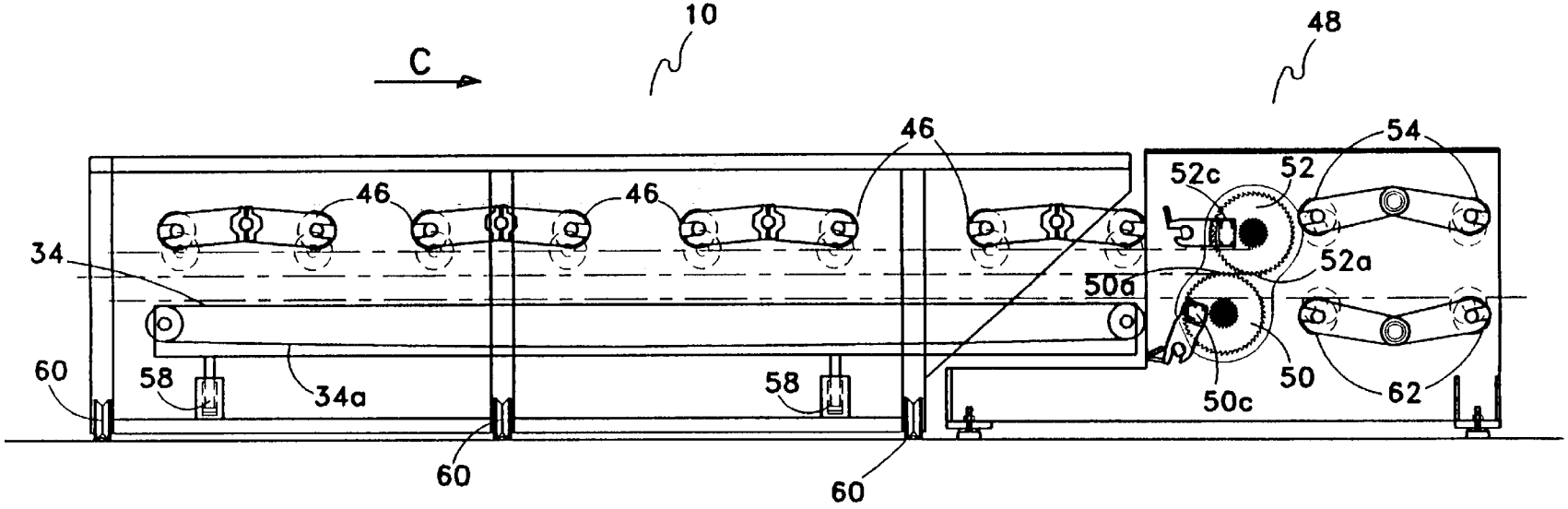
FIG. 4 is an elevation section view according to a preferred embodiment of the invention, taken along section line 4—4 in FIG. 3.

The positioning table infeed apparatus 10 may then be moved laterally in direction B as seen in FIG. 3, by actuation of selectively actuable translation means such as selectively actuable cylinder 53 shown in FIG. 2, so as to move cant 14 laterally relative to the saw blade clusters 50 and 52. Cant 14 is thereby positioned in front of the desired saw arbor zone, if the saw arbor has more than one zone.

Figure 6:
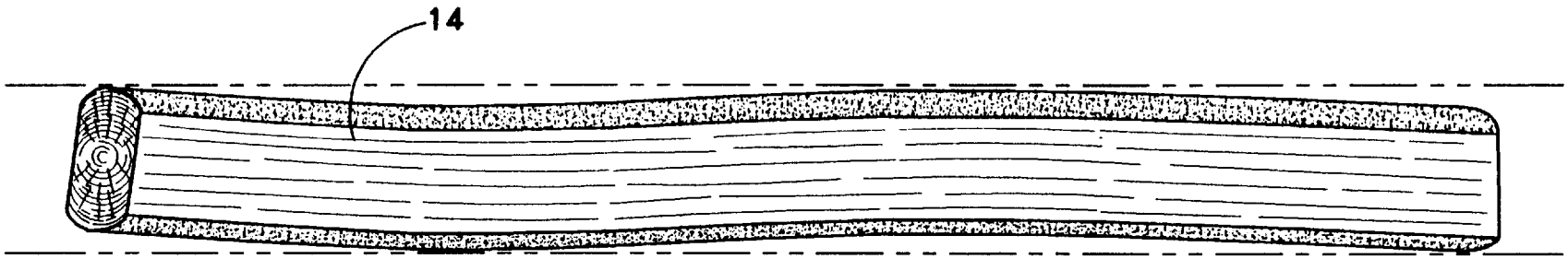
FIG. 6 is a perspective view of a two sided curved cant.

Once cant 14 is thus positioned, driven sharpchain 34*a*, with the assistance of the driven press rolls 46, begin to feed cant 14 in direction C into saw clusters 50 and 52. As cant 14 is fed into saw clusters 50 and 52, positioning table infeed apparatus 10 may, if curve sawing is desired, be actively translated in direction B on guide rollers 60 along guide rails 60*a* as needed to follow the optimum curve of cant 14. The optimum curve is the optimum cutting solution determined by an optimizer program processing data from scanner 16 corresponding to the profile of the curved cant, such as seen in FIG. 6. If only a curve sawing arc of approximately 2 inches in 20 feet is required, gang saw 48 may remain fixed. Otherwise, for curve sawing it is desirable to actively skew gang saw 48 in a coordinated position with the active lateral translation of apparatus 10.

Saw blade clusters 50 and 52 are stabilized while rotating by saw blade guides 50*c* and 52*c*. Cant 14, now boards (not shown), is finished being fed through gang saw 48 by second group of driven pressrolls 54. Driven pressrolls 54 may translate laterally with the infeed because cant 14 is also being translated laterally. Lower bed rolls 62 have adjustable elevation to assist in engaging cant 14. Cant 14 is drawn through saw blade clusters 50 and 52 in a straight line for the last short length as the chain bed 34 and driven press rolls 46 lose their engagement with, and control of, cant 14. Driven press rolls 54 drive cant 14 onto gang saw outfeed rollcase 56 for transfer downstream for further processing.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A device for feeding a workpiece into a gang saw sawblade cluster comprising longitudinal drive means for selectively longitudinally translating a workpiece, which has been sequenced onto said longitudinal drive means, into a gang saw sawblade cluster, selective positioning means for selectively positioning said longitudinal drive means relative to said gang saw sawblade cluster as said longitudinal drive means translates said workpiece longitudinally into said gang saw sawblade cluster, wherein said selective positioning means includes an optimizing elevation means for selectively raising and lowering said longitudinal drive means, so as to preset an optimized feed elevation of said workpiece, relative to said gang saw sawblade cluster as said longitudinal drive means translates said workpiece longitudinally into said gang saw sawblade cluster;

and wherein said selective longitudinal translation of said workpiece by said longitudinal drive means and said selective positioning of said longitudinal drive means relative to said gang saw sawblade cluster by said selective positioning means is selectively coordinated by coordinating means, during said feeding of said workpiece into said gang saw sawblade cluster, according to an optimizing algorithm, operating on scanned data corresponding to said workpiece, for generating a unique cutting solution for said workpiece.

2. The device of claim 1 wherein said selective positioning means further includes a lateral translation means for selectively laterally translating said longitudinal drive means.

3. The device of claim 1 wherein said selective positioning means further includes an active lateral translation means for actively selectively laterally translating said longitudinal drive means, so as to preset a starting feed position of said workpiece corresponding to a selected zone of said gang saw sawblade cluster and so as to actively position said workpiece, as said longitudinal drive means translates said workpiece longitudinally into said gang saw sawblade cluster.

4. The device of claim 3 in combination with skewing means for actively skewing, said gang saw sawblade cluster about a vertical axis wherein said selective coordination according to said optimizing algorithm includes in said selective coordination of said rotation said sawblade cluster about said vertical axis.

5. The device of claim 1 wherein said gang saw sawblade cluster is a double saw arbor having upper and lower saw arbors and said elevation means selectively raises or lowers said longitudinal drive means to equal an upper depth of cut with a lower depth of cut corresponding to said upper and lower saw arbors.

6. The device of claim 1 wherein said gang saw sawblade cluster is an overhead single arbor and said elevation means selectively raises or lowers said longitudinal drive means so as to place said workpiece into optimal proximity to saw guides on said saw arbor.

7. A method for feeding a workpiece into a gang saw sawblade cluster comprising the steps of (a) sequencing a workpiece onto a longitudinal drive means, (b) selectively longitudinally translating the workpiece from the longitudinal drive means into a gang saw sawblade cluster, (c) selectively positioning, by means of a selective positioning means, said longitudinal drive means relative to said gang saw sawblade cluster as said longitudinal drive means translates said workpiece longitudinally into said gang saw sawblade cluster, (d) coordinating, during said step of selectively longitudinally translating said workpiece on said longitudinal drive means into said gang saw sawblade cluster, said selective longitudinal translation of said workpiece by said longitudinal drive means and said selective positioning of said longitudinal drive means relative to said gang saw sawblade cluster according to an optimizing algorithm, wherein said optimizing algorithm operates on data, from a scanner, unique to said workpiece for generating a unique cutting solution for said workpiece, wherein the step of selectively positioning said longitudinal drive means comprises selectively raising and lowering said longitudinal drive means, by means of optimizing elevation means, so as to preset an optimized feed elevation of said workpiece, relative to said gang saw sawblade cluster as said longitudinal drive means translates said workpiece longitudinally into said gang saw sawblade cluster.

8. The method of claim 7 wherein the step of selectively positioning said longitudinal drive means comprises selectively laterally translating, by means of lateral translation means, said longitudinal drive means, so as to preset a starting feed position of said workpiece corresponding to a selected zone of said gang saw sawblade cluster and so as to actively position said workpiece, as said longitudinal drive means translates said workpiece longitudinally into said gang saw sawblade cluster.

9. The method of claim 7 wherein the step of selectively positioning said longitudinal drive means comprises selectively laterally translating said longitudinal drive means by means of lateral translation means, so as to preset a starting feed position of said workpiece corresponding to a selected zone of said gang saw sawblade cluster and so as to actively position said workpiece, as said longitudinal drive means translates said workpiece into said gang saw sawblade cluster.

10. The method of claim 9 in combination with the step of skewing said gang saw sawblade cluster, by means of rotating means, about a vertical axis and wherein the step of selective coordination according to said optimizing algorithm includes selective coordination of said rotating of said sawblade cluster about said vertical axis.

11. The method of claim 7 wherein said gang saw sawblade cluster is a double saw arbor having upper and lower saw arbors and said step of selectively raising or lowering said longitudinal drive means equalizes upper and lower saw cut depths corresponding to said upper and lower saw arbors.

12. The method of claim 7 wherein said gang saw sawblade cluster is an overhead single arbor and said step of selectively raising or lowering said longitudinal drive means positions said workpiece into optimal proximity to saw guides on said saw arbor.

13. A device for feeding a workpiece into a gang saw sawblade cluster comprising longitudinal drive means for selectively longitudinally translating a workpiece, which has been sequenced onto said longitudinal drive means, into a gang saw sawblade cluster, selective positioning means for selectively positioning said longitudinal drive means relative to said gang saw sawblade cluster as said longitudinal drive means translates said workpiece longitudinally into said gang saw sawblade cluster, wherein said selective positioning means includes an elevation means for selectively raising and lowering said longitudinal drive means, so as to preset a feed elevation of said workpiece, relative to said gang saw sawblade cluster as said longitudinal drive means translates said workpiece longitudinally into said gang saw sawblade cluster, wherein said selective positioning means further includes a lateral translation means for selectively laterally translating said longitudinal drive means.

14. A device for feeding a workpiece into a gang saw sawblade cluster comprising longitudinal drive means for selectively longitudinally translating a workpiece, which has been sequenced onto said longitudinal drive means, into a gang saw sawblade cluster, selective positioning means for selectively positioning said longitudinal drive means relative to said gang saw sawblade cluster as said longitudinal drive means translates said workpiece longitudinally into said gang saw sawblade cluster, wherein said selective positioning means includes an elevation means for selectively raising and lowering said longitudinal drive means, so as to preset a feed elevation of said workpiece, relative to said gang saw sawblade cluster as said longitudinal drive means translates said workpiece longitudinally into said gang saw sawblade cluster, wherein said selective positioning means further includes an active lateral translation means for actively selectively laterally translating said longitudinal drive means, so as to preset a starting feed position of said workpiece corresponding to a selected zone of said gang saw sawblade cluster and so as to actively position said workpiece, as said longitudinal drive means translates said workpiece longitudinally into said gang saw sawblade cluster, wherein said selective longitudinal translation of said workpiece by said longitudinal drive means and said selective positioning of said longitudinal drive means relative to said gang saw sawblade cluster by said selective positioning means is selectively coordinated, by co-ordinating means, according to an optimizing algorithm, operating on scanned data corresponding to said workpiece, for generating a unique cutting solution for said workpiece.

15. The device of claim 14 in combination with skewing means for actively skewing said gang saw sawblade cluster about a vertical axis wherein said selective coordination according to said optimizing algorithm includes in said selective coordination of said rotation said sawblade cluster about said vertical axis.

16. A method for feeding a workpiece into a gang saw sawblade cluster comprising the steps of (a) sequencing a workpiece onto a longitudinal drive means, (b) selectively longitudinally translating the workpiece from the longitudinal drive means into a gang saw sawblade cluster, (c) selectively positioning, by means of a selective positioning means, said longitudinal drive means relative to said gang saw sawblade cluster as said longitudinal drive means translates said workpiece longitudinally into said gang saw sawblade cluster, wherein the step of selectively positioning said longitudinal drive means comprises selectively raising and lowering said longitudinal drive means, by means of elevation means, so as to preset a feed elevation of said workpiece, relative to said gang saw sawblade cluster as said longitudinal drive means translates said workpiece longitudinally into said gang saw sawblade cluster, wherein the step of selectively positioning said longitudinal drive means comprises selectively laterally translating, by means of lateral translation means, said longitudinal drive means, so as to preset a starting feed position of said workpiece corresponding to a selected zone of said gang saw sawblade cluster and so as to actively position said workpiece, as said longitudinal drive means translates said workpiece longitudinally into said gang saw sawblade cluster.

17. A method for feeding a workpiece into a gang saw sawblade cluster comprising the steps of (a) sequencing a workpiece onto a longitudinal drive means, (b) selectively longitudinally translating the workpiece from the longitudinal drive means into a gang saw sawblade cluster, (c) selectively positioning, by means of a selective positioning means, said longitudinal drive means relative to said gang saw sawblade cluster as said longitudinal drive means translates said workpiece longitudinally into said gang saw sawblade cluster, wherein the step of selectively positioning said longitudinal drive means comprises selectively raising and lowering said longitudinal drive means, by means of elevation means, so as to preset a feed elevation of said workpiece, relative to said gang saw sawblade cluster as said longitudinal drive means translates said workpiece longitudinally into said gang saw sawblade cluster, wherein the step of selectively positioning said longitudinal drive means comprises selectively laterally translating said longitudinal drive means by means of lateral translation means, so as to preset a starting feed position of said workpiece corresponding to a selected zone of said gang saw sawblade cluster and so as to actively position said workpiece, as said longitudinal drive means translates said workpiece into said gang saw sawblade cluster.

18. The method of claim 17 in combination with the step of skewing said gang saw sawblade cluster, by means of rotating means, about a vertical axis and wherein the step of selective coordination according to said optimizing algorithm includes selective coordination of said rotating of said sawblade cluster about said vertical axis.

19. A device for feeding a workpiece into a gang saw sawblade cluster comprising longitudinal drive means for selectively longitudinally translating a workpiece, which has been sequenced onto said longitudinal drive means, into a gang saw sawblade cluster, selective positioning means for selectively positioning said longitudinal drive means relative to said gang saw sawblade cluster as said longitudinal drive means translates said workpiece longitudinally into said gang saw sawblade cluster, wherein said selective positioning means includes a lateral translation means for actively positioning said longitudinal drive means by selectively laterally translating said longitudinal drive means as said longitudinal drive means translates said workpiece longitudinally into said gang saw sawblade cluster.

20. A device for feeding a workpiece into a gang saw sawblade cluster comprising longitudinal drive means for selectively longitudinally translating a workpiece, which has been sequenced onto said longitudinal drive means, into a gang saw sawblade cluster, selective positioning means for selectively positioning said longitudinal drive means relative to said gang saw sawblade cluster as said longitudinal drive means translates said workpiece longitudinally into said gang saw sawblade cluster, wherein said selective positioning means further includes an active lateral translation means for actively selectively laterally translating said longitudinal drive means, so as to preset a starting feed position of said workpiece corresponding to a selected zone of said gang saw sawblade cluster and so as to actively position said workpiece, as said longitudinal drive means translates said workpiece longitudinally into said gang saw sawblade cluster, wherein said selective longitudinal translation of said workpiece by said longitudinal drive means and said selective positioning of said longitudinal drive means relative to said gang saw sawblade cluster by said selective positioning means is selectively coordinated, by coordinating means, according to an optimizing algorithm, operating on scanned data corresponding to said workpiece, for generating a unique cutting solution for said workpiece.

* * * * *